US006914567B2

(12) United States Patent
Trumbull

(10) Patent No.: US 6,914,567 B2
(45) Date of Patent: Jul. 5, 2005

(54) BROADBAND COMBINATION MEANDERLINE AND PATCH ANTENNA

(75) Inventor: Thomas Trumbull, Los Gatos, CA (US)

(73) Assignee: Centurion Wireless Technologies, Inc., Lincoln, NE (US)

( * ) Notice: Subject to any disclaimer, the term of this patent is extended or adjusted under 35 U.S.C. 154(b) by 0 days.

(21) Appl. No.: 10/367,073

(22) Filed: Feb. 14, 2003

(65) Prior Publication Data

US 2004/0160366 A1 Aug. 19, 2004

(51) Int. Cl.[7] ..... H01Q 1/24; H01Q 1/38
(52) U.S. Cl. ..... 343/702; 343/700 MS
(58) Field of Search ..... 343/700 MS, 895, 343/909, 846, 702

(56) References Cited

U.S. PATENT DOCUMENTS 6,320,545 B1 * 11/2001 Nagumo et al. ..... 343/700 MS
6,388,626 B1 * 5/2002 Gamalielsson et al. ..... 343/702
6,452,556 B1 * 9/2002 Ha et al. ..... 343/702
6,466,174 B2 10/2002 Haussler et al. ..... 343/700 MS
6,486,844 B2 * 11/2002 Thursby et al. ..... 343/744
6,504,511 B2 * 1/2003 Andersson ..... 343/702
2002/0149521 A1 * 10/2002 Hendler et al. ..... 343/700 MS
2003/0137457 A1 * 7/2003 McKinzie et al. ... 343/700 MS

* cited by examiner

*Primary Examiner*—Shih-Chao Chen
*Assistant Examiner*—Minh Dieu A
(74) *Attorney, Agent, or Firm*—Holland & Hart LLP

(57) ABSTRACT

The performance of a dual band meanderline antenna is improved with the addition of a conductive patch. It is well known that a meanderline antenna will have various resonances. A conductive patch capacitively coupled to the meanderline broadens and move the second resonance frequency. Connecting the conductive patch to a coherent power source causes additional bandwidth enhancements.

22 Claims, 4 Drawing Sheets

BROADBAND COMBINATION MEANDERLINE AND PATCH ANTENNA

RELATED PATENT

U.S. Pat. No. 6,466,174, issued Oct. 15, 2002, titled "SURFACE MOUNT CHIP ANTENNA, is related to the present invention. The disclosure of U.S. Pat. No. 6,466,174 is incorporated herein by reference.

FIELD OF THE INVENTION

The present invention relates to antenna and, more particularly to an ultra-wide band communication antenna combining meanderline and patch antennas.

BACKGROUND OF THE INVENTION

Wireless devices increase their usefulness with each standardized communication channel on which they can operate. Often, operation on multiple communication channels requires operation on different frequencies bands. For example, 802.11 is grouped into multiple bands of operation. An antenna that operated on 2 of the bands (i.e, dual band) would be more valuable than a single frequency antenna. Further, a tri-band (3 bands) would be more valuable than a dual band.

Communication frequency bands may overlap or be in sufficiently close proximity that the effect is a wider bandwidth than any one communication channel. Also, wider bandwidths are necessary for some high data rate transmissions, such as video streaming and the like.

To accommodate these wider bandwidths and multiple communication channels, many wireless devices have incorporated multiple antennas. While this works, it increases the complexity of the wireless device, the size of the wireless device, and the cost to manufacture the wireless device. Another solution would be to provide a log periodic antenna, but log periodic antennas generally require fairly large structure with multiple elements.

One common antenna useful to operate across multiple bands is a planar inverted F antenna (PIFA). PIFAs provide a good match (without a matching network) at different frequencies simultaneously to allow multiple band operation. However, when bands are close together in frequency, the match becomes difficult to achieve.

Another problem with the PIFA is that as the size of the PIFA is reduced to accommodate smaller and smaller handheld style devices, the bandwidth of the PIFA shinks as well. In other words, the minimum bandwidth of a PIFA often limits the maximum size reduction. An important measure of antenna bandwidth is called percentage bandwidth, or PBW. PBW is computed as $$PBW=(f_u-f_l)/(\sqrt{f_u f_l})\times 100 \qquad \text{equation \#1}$$

In equation #1, $f_u$ is the upper frequency of the bandwidth. $f_l$ is the lower frequency of the bandwidth. For the typical handheld wireless device, most PIFAs have a 10% PBW.

Thus, it would be desirable to develop a multi-band antenna having a wide bandwidth.

SUMMARY OF THE INVENTION

To attain the advantages of and in accordance with the purpose of the present invention, antenna assemblies with having a meanderline element and a patch element are provided.

The foregoing and other features, utilities and advantages of the invention will be apparent from the following more particular description of a preferred embodiment of the invention as illustrated in the accompanying drawings.

BRIEF DESCRIPTION OF THE DRAWING

The above and other objects and advantages of the present invention will be apparent upon consideration of the following detailed description, taken in conjunction with the accompanying drawings, in which like reference characters refer to like parts throughout, and in which.

DETAILED DESCRIPTION

Figure 1:
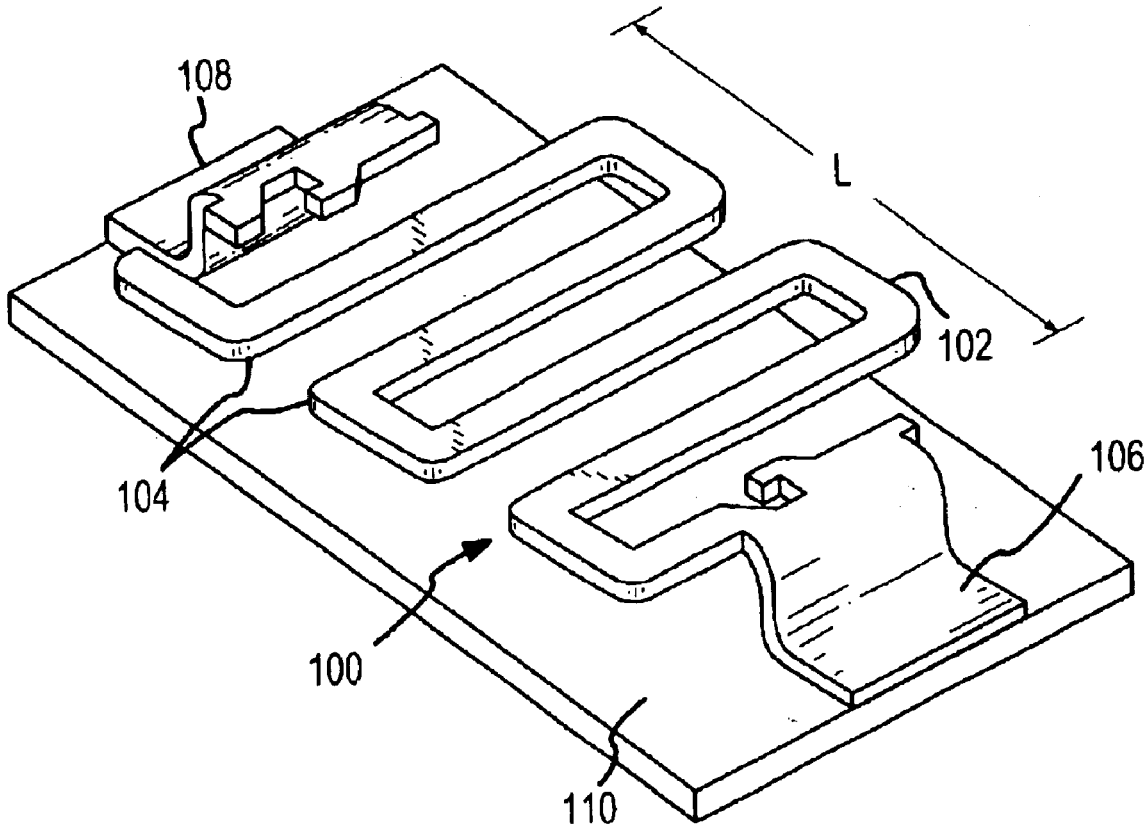
FIG. 1 is perspective view of a meanderline antenna associated with the present invention.
Figure 2:
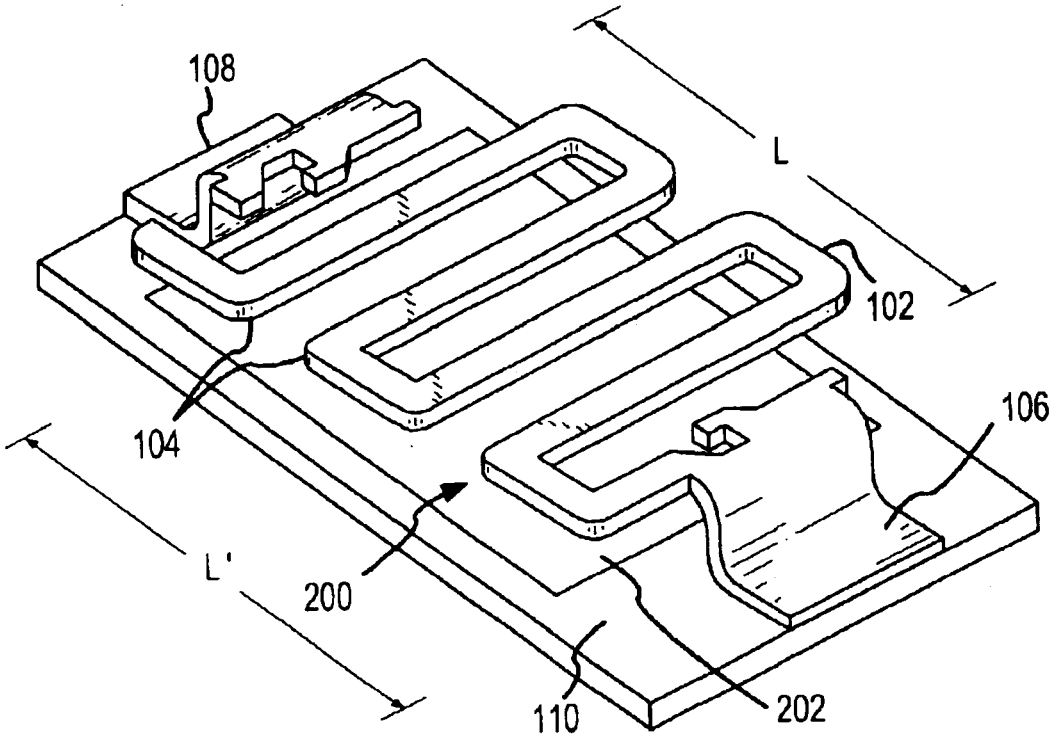
FIG. 2 is a perspective view of a combination meanderline and patch antenna consistent with the present invention.

The present invention will be described with reference to FIGS. 1–3. FIG. 1 shows a possible meanderline antenna 100 (Meanderline and Meander are used interchangedly in this application). Meanderline antenna 100 includes a conductive trace 102 having a series of parallel elements 104 forming a serpentine configuration. As shown, conductive trace 102 has a length L. A lead 106 formed on one end of conductive trace 102 to provide a feed. A second lead 108 (not required but provided in this embodiment) provides a support lead for mechanical stability and is isolated in this embodiment but may be grounded depending on length L. The meander works with a counterpoise (not shown) which typically forms the ground plane for the RF signal applied to lead 106. In this embodiment, leads 106 and 108 are off-set from conductive trace 102 so it resides above the substrate plane 110. The substrate for meanders is typically free from ground. The substrate 110 could be the top layer of a multi-plane PCB that is cleared of metallization on all layers in a keep-out area beneath the meander antenna 100. It could also be the absence of any material whatsoever in the keep-out area. Meanderline antenna 100 provides multi-band functionality by itself. Resonance in various frequency bands can be accomplished by changing the length of the conductive trace 102, the distance between parallel elements 104, and the like.

Figure 4:
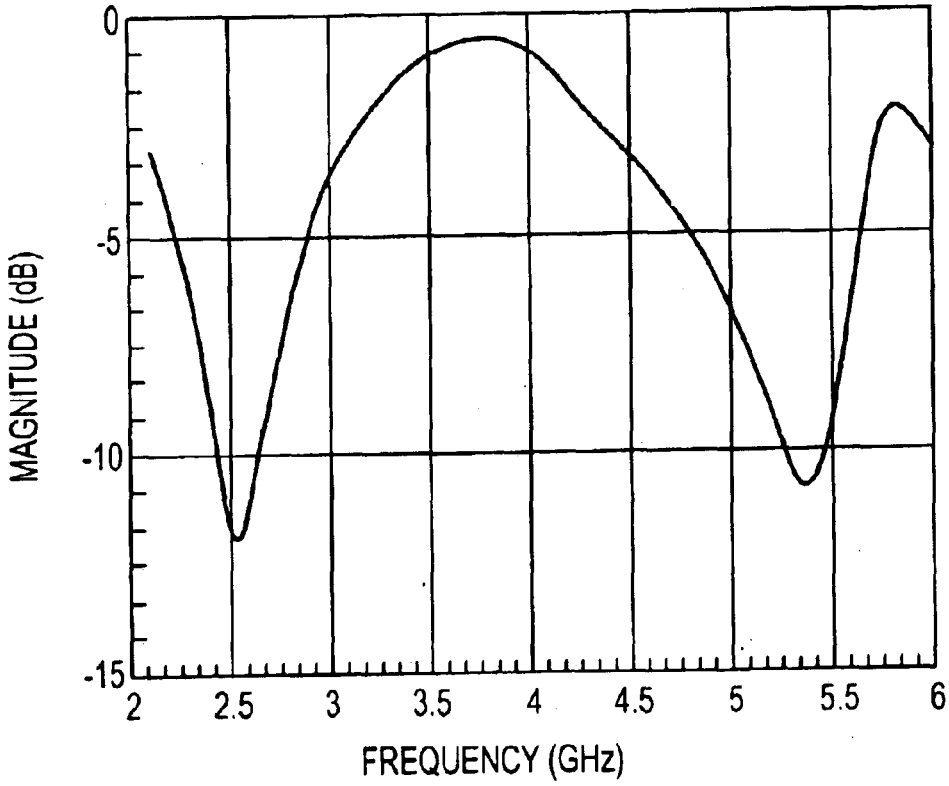
FIG. 4 is a plot relating power to frequency of the combination antenna of FIG. 2.

It has been discovered that adding a patch element 202 changes the width and resonant frequency of one or more communication bands on which meanderline antenna 100 operates. Such a combination antenna 200 is shown in FIG. 2. Combination antenna 200 includes conductive trace 102 and patch element 202. As shown, patch element 202 resides in substrate plane 110 parallel to conductive trace 102. However, patch element 202 could reside anywhere in relation to conductive trace 102, such as above or below conductive trace 102 as a matter of design choice. As shown, patch element 202 substantially aligns with conductive trace 102. Patch antenna 202 has a length L'. FIG. 4 shows a possible plot of power vs. frequency for combination antenna 200. In this case, the antenna has two relatively wide channels of operation channel 1 is around 2.6 GHz and channel 2 is around 5.35 GHz. The specific tuning of channel 1 and channel 2 is exemplary, and could be altered. Further, while patch element 202 is shown substantially aligned with conductive trace 102, patch element 202 could be angled, off-set, or have different dimensions, such as a shorter length. The principle of the patch is that it provides capacitive coupling of the meander to a metallic body (which may or may not be connected to the meander). It is just the proximity of a piece of metallization, capacitively coupled to the meander that is causing the effect. This embodiment has the patch beneath the meander, but it can be anywhere and any orientation. Another embodiment has the patch/meander combination at an angle to a PCB, such as a right angle. The closer the patch is to the meander, smaller patches can be used.

Figure 3:
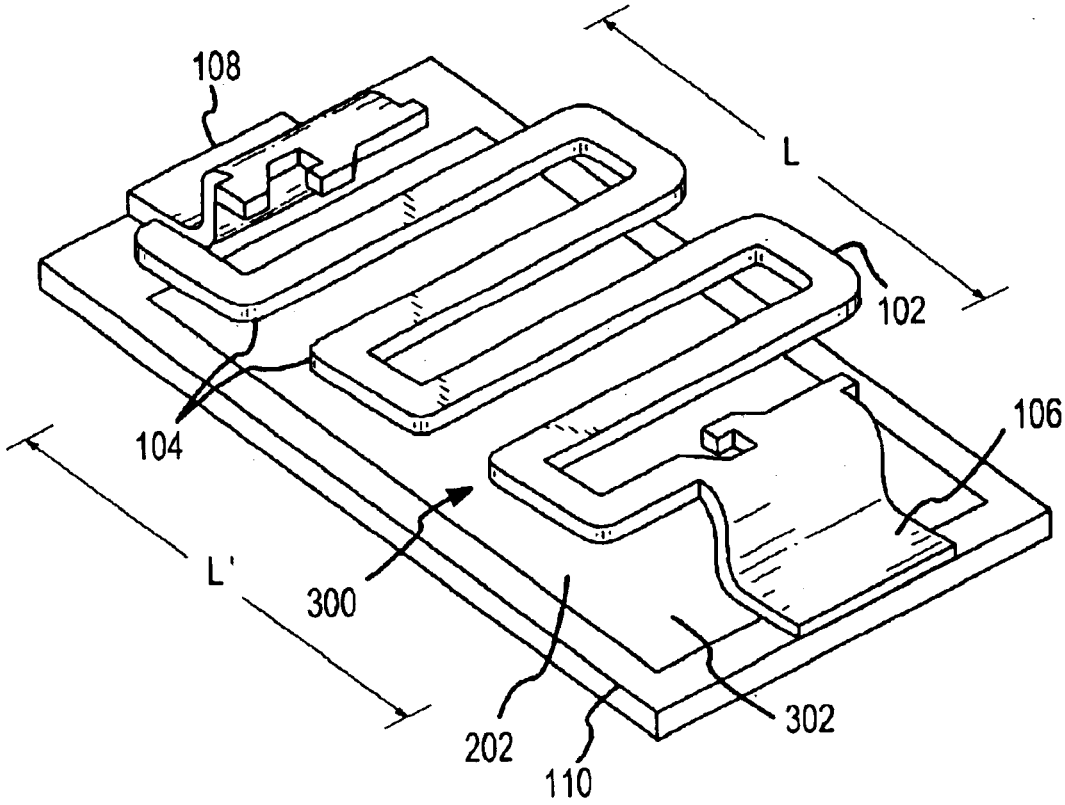
FIG. 3 is a perspective view of another combination meanderline and patch antenna consistent with the present invention.
Figure 5:
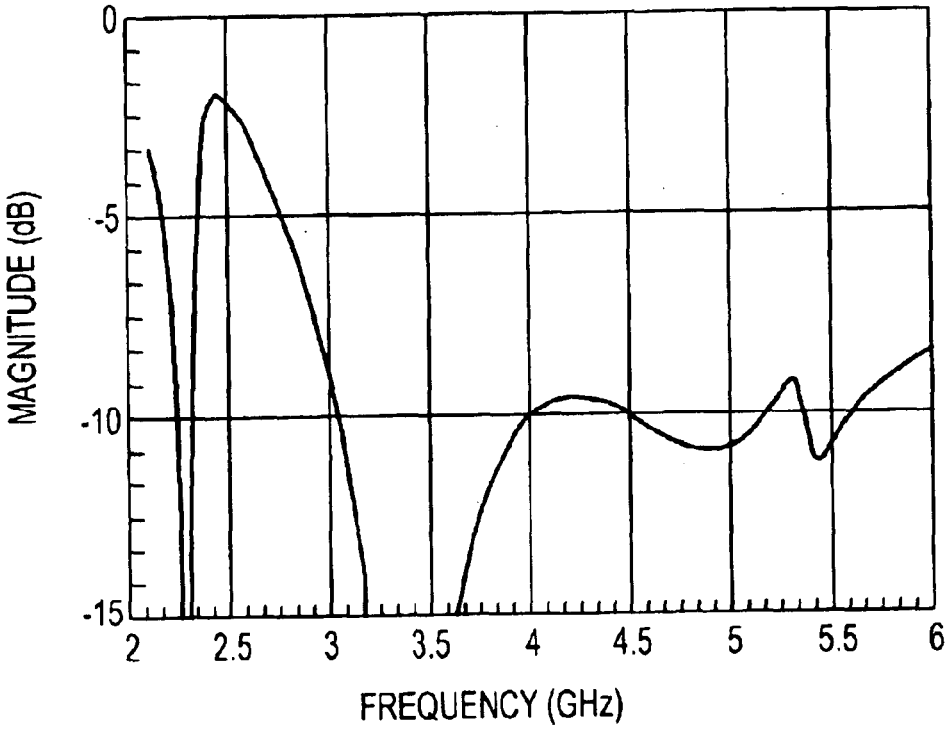
FIG. 5 is a plot relating power to frequency of the combination antenna of FIG. 3.

FIG. 3 shows another combination meanderline antenna 300. Meanderline antenna 300 includes the identical elements to meanderline antenna 200, but also includes patch element feed 302. Patch element feed 302 provides conductive path to patch element 202. Patch feed element 302 is shown as a continuation or extension of patch element 202, but could be any conventional material capable of conducting power to patch element 202 including without limitation a power feed, and/or a coherent power source (not shown) separate from lead 106. Providing power to patch element 202 may result in power vs frequency plot as shown in FIG. 5. As shown in FIG. 5, supplying power to patch element 202 increases the usable bandwidth of the antenna. Patch element feed 302 is shown connected to lead 106, however, patch element feed 302 could be separately connected to a coherent power source (not shown).

On reading the disclosure, one of skill in the art will now recognize that a patch element, such as patch element 202, couple be attached to a conventional meanderline antenna. For example, meanderline antenna 100 could be improved by adding a patch element to the antenna. The patch element could be etched into a printed circuit board, for example, and attached to antenna 100 using any conventional means to provide the combination meanderline, patch antenna. Such conventional means to attach the meander antenna to a PCB could be to solder to patch feed 302, screws or bolts to attach a patch element above antenna 100 (not shown), friction fittings, snap locks, or the like.

While the invention has been particularly shown and described with reference to an embodiment thereof, it will be understood by those skilled in the art that various other changes in the form and details may be made without departing from the spirit and scope of the invention.

What is claimed is:

1. A dual frequency antenna comprising:

an electrically conductive trace having a first end and a body element;

the body element comprising a plurality of parallel elements such that the body element comprises a meanderline;

the first end adapted to be coupled to a power source;

a patch element; and the patch element coupled to the body element, wherein the patch element resides in a different plane than the body element, the different plane being substantially parallel to the body element.

2. The antenna according to claim 1, wherein the patch element resides in a plane beneath the meanderline.

3. The antenna according to claim 1, wherein the conductive trace comprises a second end.

4. The antenna according to claim 1, wherein the patch element is capacitively coupled to the conductive trace.

5. The antenna according to claim 1, wherein the patch element is coupled to the conductive trace through a conductive patch element feed.

6. The antenna according to claim 1, further comprising a patch element feed, the patch element feed adapted to couple the patch element to a coherent power source.

7. The antenna according to claim 1, wherein the patch element is parallel to the conductive trace.

8. A wireless device having an antenna comprising:

a printed circuit board;

a meanderline antenna;

the meanderline antenna comprising a plurality of parallel elements, the meanderline antenna having a first end coupled to the printed circuit board;

the first end coupled to a power source; and a patch element residing on the printed circuit board such that the patch element is coupled to the meanderline and the patch element resides in a plane different than the meanderline, the different plane being substantially parallel to the meanderline.

9. The wireless device according to claim 8, wherein the patch element is capacitively coupled to the meanderline.

10. The wireless device according to claim 8, wherein the patch element is conductively coupled to the meanderline by a patch element feed.

11. The wireless device according to claim 8, further comprising a patch element feed adapted to be coupled to a coherent power source.

12. The wireless device according to claim 11, wherein the patch element feed is coupled to the first end.

13. The wireless device according to claim 11, wherein the patch element feed is coupled to a feed on the printed circuit board.

14. The wireless device according to claim 11, wherein the patch element feed is adapted to be connected to the power source by a via.

15. A dual frequency antenna comprising:

an electrically conductive trace having a first end, a second end, and a body element;

the body element comprising a plurality of parallel elements such that the body element comprises a meanderline;

the first end adapted to be coupled to a power source;

and means residing in a plane different than and substantially parallel to the meanderline for broadening the bands of operation of the meanderline antenna.

16. The antenna according to claim 15, wherein the means for broadening is a patch element.

17. The antenna according to claim 16, wherein the patch element further comprises a patch element conductive feed for supplying power to the patch element.

18. A patch element for a meanderline antenna comprising:

a patch element; and means for attaching the patch element to the meanderline antenna such that the patch element resides in a plane different than the meanderline antenna, the plane different than the meanderline antenna being substantially parallel to the meanderline antenna.

19. The patch element according to claim 18, wherein the means for attaching comprises at least one of solder, screws, snap locks, and friction fittings.

20. A dual frequency antenna comprising:

an electrically conductive trace having a first end and a body element;

the body element comprising a plurality of parallel elements such that the body element comprises a meanderline;

the first end adapted to be coupled to a power source;

a patch element, the patch element residing in a plane substantially parallel to the body element; and the patch element coupled to the body element, such that the power source feeds the body element and the patch element in parallel.

21. The antenna according to claim 20, wherein the patch element resides in a different plane than the body element.

22. The antenna according to claim 20, wherein the patch element is coupled to the body element through a conductive patch element feed.

* * * * *